United States Patent [19]

Landa

[11] 4,400,079

[45] Aug. 23, 1983

[54] INJECTION ROLLER DEVELOPER FOR ELECTROPHOTOGRAPHIC COPIER AND BIASING SYSTEM THEREFOR

[75] Inventor: Benzion Landa, Alberta, Canada

[73] Assignee: Savin Corporation, Valhalla, N.Y.

[21] Appl. No.: 190,369

[22] Filed: Sep. 24, 1980

[51] Int. Cl.[3] ..... G03G 15/10

[52] U.S. Cl. ..... 355/10; 118/661

[58] Field of Search ..... 355/10; 118/661; 430/117-119

[56] References Cited

U.S. PATENT DOCUMENTS

| | | | |
|---|---|---|---|
| 3,299,787 | 1/1967 | Kolb et al. | 355/10 |
| 3,367,791 | 2/1968 | Lein | 118/661 X |
| 3,627,557 | 12/1971 | Sato et al. | 118/246 X |
| 3,870,514 | 3/1975 | Sato et al. | 355/10 X |
| 3,907,423 | 9/1975 | Hayashi et al. | 355/10 |
| 4,017,174 | 4/1977 | Cheeseman | 355/10 |
| 4,259,005 | 3/1981 | Kuehnle | 355/10 |

*Primary Examiner*—R. L. Moses

*Attorney, Agent, or Firm*—Shenier & O'Connor

[57] ABSTRACT

A developing system for an electrophotographic copier in which a roller having a conductive outer surface is disposed adjacent to the imaging surface to form a gap. The roller is driven at a peripheral linear velocity substantially greater than the velocity of movement of the imaging surface and is supplied with liquid developer at a location spaced from the gap to cause the roller to inject the developer into the gap. The roller is coupled to a source of potential through a gas discharge tube to maintain the potential of the electrode within predetermined limits.

12 Claims, 3 Drawing Figures

INJECTION ROLLER DEVELOPER FOR ELECTROPHOTOGRAPHIC COPIER AND BIASING SYSTEM THEREFOR

BACKGROUND OF THE INVENTION

This invention relates to apparatus for developing a latent electrostatic image formed on the imaging surface of an electrophotographic copier, including an electrical biasing system especially intended for use therewith.

Systems that develop electrostatic latent images by applying to the imaging surface an essentially insulating carrier liquid containing suspended charged toner particles are well known in the art. In such systems, it is common to employ a developing electrode to ensure proper development of broad images and to prevent the deposition of toner particles in "background" regions that correspond to the white background of an original but which nevertheless retain some electrostatic charge.

In one type of liquid developing system, shown in Miyakawa et al. U.S. Pat. No. 4,035,071, a curved development electrode is disposed in closely spaced relation with the photoconductive imaging drum, and developer is supplied to the region of adjacency through an orifice in the electrode. The electrode is provided with a "biasing" potential greater than that of the background areas of the latent image but less than that of the areas corrresponding to the printed or typed portions of the original. A common method of biasing the development electrode is simply to allow it to float electrically, within predetermined limits, so that it assumes the average potential of the adjacent imaging surface. As a result of this biasing potential, the electrical field in the background portions of the region of adjacency is of such a polarity as to draw toner particles toward the electrode rather than toward the imaging surface, thus preventing undersirable "background" deposition.

While developing electrodes of the prior art prevent background deposition on nonimage areas, they also introduce problems of their own. Since a very high percentage of a typical original consists of background areas, the usual direction of toner particle migration in the region between the electrode and the imaging surface will be in the direction of the electrode. As a result, the developing electrode gradually accumulates a toner deposit of its own, which eventually interferes with the operation of the developing system. While it is possible to remove this deposit electrically by applying a biasing potential of opposite polarity, this necessitates an additional cleaning operation.

Further, since the development electrode must be placed relatively far from the imaging surface to provide the necessary clearance, the region of adjacency is preferably made relatively long circumferentially to allow toner particles nearer the electrode to migrate across the gap to the imaging surface. This results in a developing station of appreciable circumferential extent, thus limiting the possibilities for reducing the size of the copier.

In addition to the foregoing, if a development electrode of appreciable circumferential extent is allowed to float electrically, the level of biasing potential present when the leading portion of the latent image enters the developing region is influenced not only by the average potential of that image portion, but also by the average potential on the preceding non-image-carrying portion of the imaging surface already in the developing region. If the average potential of this preceding portion is lower than that of the leading image portion, the development electrode will be underbiased and may allow toner deposition in background areas.

SUMMARY OF THE INVENTION

One of the objects of my invention is to provide a developing system for an electrophotographic copier which operates relatively rapidly.

Another object of my invention is to provide a developing system for an electrophotographic copier which does not occupy excessive space around the photoconductive imaging drum.

Still another object of my invention is to provide a developing system for an electrophotographic copier which is able to adapt nearly immediately to changes in the average potential of the drum surface.

A further object of my invention is to provide a developing system for an electrophotographic copier which facilitates the use of a floating electrode.

Another object of my invention is to provide a developing system for an electrophotographic copier which does not produce copies having gray leading edges.

Still another object of my invention is to provide a developing system for an electrophotographic copier which is self-cleaning.

A further object of my invention is to provide a developing system for an electrophotographic copier which is simple and inexpensive.

Other and further objects of my invention will be apparent from the following description.

In general, my invention contemplates apparatus for developing an electrostatic image on an imaging surface in which a roller having a conductive outer surface is disposed adjacent to the imaging surface to form a gap therebetween. The roller is driven at a peripheral linear velocity substantially greater than the velocity of movement of the imaging surface, and liquid developer is supplied to the surface of the roller at a location spaced from the gap.

Preferably, the injection roller is coupled to a source of potential through a gas discharge tube to maintain the potential of the electrode within predetermined limits. As long as the difference in potential between the developing electrode and the potential source remains below the breakdown voltage of the gas discharge tube, the discharge tube acts virtually as a perfect insulator, thus allowing the electrode to follow accurately the average potential on the adjacent portion of the imaging surface. Preferably, the source of potential comprises one or more additional gas discharge tubes coupled in series between the imaging layer substrate and an electrode placed in a corona such as the charge corona.

BRIEF DESCRIPTION OF THE DRAWINGS

In the accompanying drawings to which reference is made in the instant specification and in which like reference characters are used to indicate like parts in the various views.

DETAILED DESCRIPTION OF THE PREFERRED EMBODIMENTS

Figure 1:
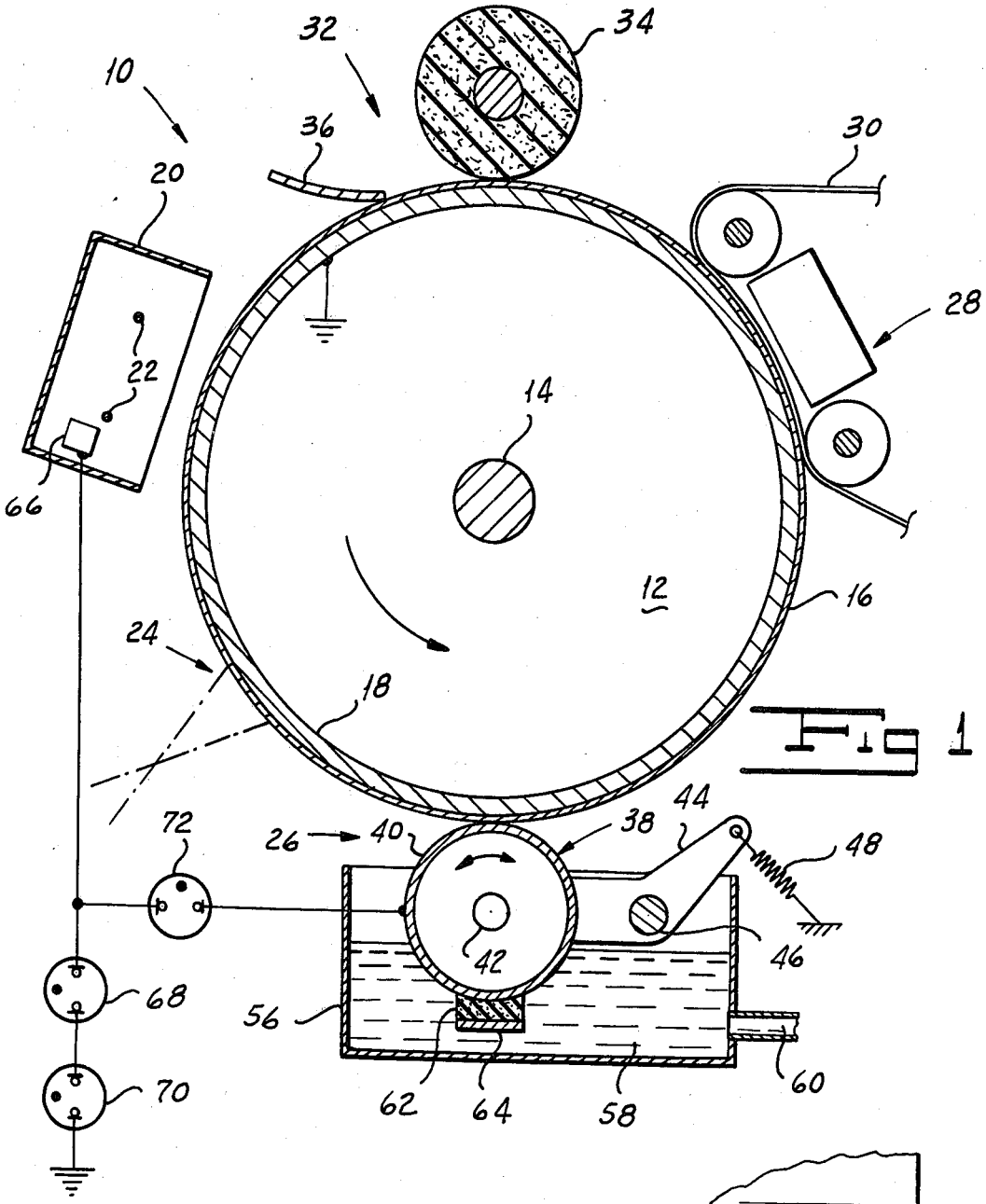
FIG. 1 is a section of an electrophotographic copier incorporating my injection roller developer and biasing system.
Figure 2:
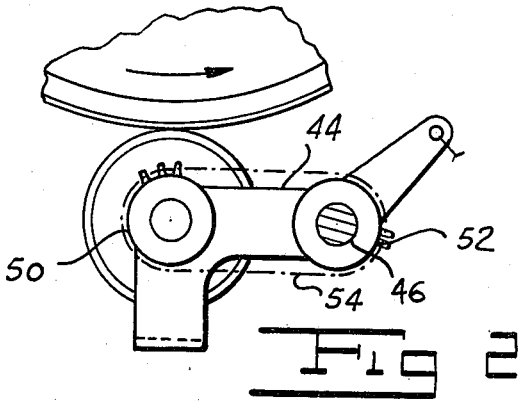
FIG. 2 is a fragmentary front elevation illustrating the drive train of the roller shown in FIG. 1.

Referring now to FIGS. 1 and 2, a copier, indicated generally by the reference numeral 10, incorporating my developing system, includes a cylindrical drum 12 supported for rotation on a shaft 14. Drum 12 includes an outer photoconductive layer 16 of selenium or the like formed on a conductive substrate 18 which is grounded. In operation, the drum 12 is rotated in the direction of the arrow to move the photoconductive imaging layer 16 first past a charge corona 20 in which an extremely high positive potential is applied to a pair of elongated electrodes 22 to ionize the surrounding air and thus provide the surface 16 with a uniform positive electrostatic charge. The imaging layer 16 next moves through an exposure station 24 in which the layer 16 is exposed to a light image of an original (not shown) to selectively discharge the surface in such a manner as to form an electrostatic latent image.

After exposure, the imaging layer moves through a developing station, indicated generally by the reference character 26, constructed according to my invention. In the developing station 26, developer liquid containing suspended toner particles is applied to the surface of the layer 14 to form a developed toner image thereon corresponding to the latent image formed at the exposure station 24. After leaving the developing station 26, the imaging layer 16 moves through a transfer station 28 at which the developed toner image is transferred to a copy sheet 30. Finally, the layer 16 moves through a cleaning station 32 in which a spongy-surfaced roller 34 supplied with cleaning liquid by means (not shown) wipingly engages the layer to scrub away remaining toner particles, while an elongated resilient wiper blade 36 acts as a seal to prevent cleaning liquid from being carried with the layer 16 out of the cleaning station 32. After leaving the cleaning station 32, the imaging layer 16 may be used in a subsequent copying cycle similar to the cycle just described.

In the developing station 26, an injection roller indicated generally by the reference numeral 38, having an outer conductive shell 40, is mounted on a pair of stub shafts 42 which in turn are rotatably supported at one end of each of a pair of arms or bell cranks 44, only one of which is illustrated in the drawings. A pivot shaft 46 rotatably supports the arms 44 to allow movement of the roller 38 toward and away from the imaging layer 16. A pair of springs 48 coupled respectively to the other ends of bell cranks 44 urge the roller 38 against the imaging layer 16 with a predetermined force.

Roller 38 is rotated at a high speed by any suitable means such as by a drive chain 54 extending between a first sprocket wheel 50 mounted on the roller shaft 42 and a second sprocket wheel 52 mounted on a pivot shaft 46. Pivot shaft 46 itself is driven by any suitable means such as by a belt or chain (not shown) coupled to the drum shaft 14 or by a separate motor (not shown). Injection roller 38 is immersed at least partly in a pool of liquid developer 58 contained in a tank 56 and replenished through an inlet 60. In the embodiment shown, I use the isoparaffin developing liquid sold by the Exxon Corporation under the trademark ISOPAR G. An elongated foam wiper pad 62 mounted on an elongated metal strip 64 secured to respective arms of the bell cranks 44 cleans the outer shell 40 of the roller 38 of any toner deposits or the like which may otherwise interfere with its operation.

The surface speed of the roller 38 is determined by the image quality desired. Obviously this surface speed is a function of angular velocity and roller diameter. For a roller diameter of between 1 and 2 inches, I have found that a roller velocity of between 800 and 2000 rpm, corresponding to a roller surface velocity of between 40 and 200 inches per second for the two extremes of roller diameter, produces good images. At a roller velocity below 800 rpm, the image quality deteriorates. On the other hand, no appreciable enhancement of the image quality is discernible at roller speeds above 2000 rpm. Nor is there any appreciable difference in the results achieved with clockwise and counterclockwise rotation of the roller 38.

To obtain a reference potential for maintaining the biasing voltage on roller 38 within suitable limits, I dispose a metal plate 66 within the corona charger 20 at a point adjacent to but spaced from the corona electrodes 22. I connect the plate 66 to ground through a pair of series-coupled neon lamps 68 and 70, each of which conducts when a potential difference of about 70 volts is applied while acting essentially as an open circuit if a lesser potential is applied. I further couple the plate 66 to the conductive shell 40 of roller 38 through a third neon lamp 72 which conveniently may also be a 70 volt lamp.

In operation, plate 66 accumulates a positive charge from the positive ions created by the corona 20. When a sufficient charge accumulates on plate 66 that its potential relative to ground reaches 140 volts, lamps 68 and 70 begin to conduct and thus dissipate the charge. As a result of the charge-accumulating action of plate 66 and the dissipating action of neon lamps 68 and 70, plate 66 stabilizes at a voltage of about 140 volts.

As long as the bias induced on the conductive shell 40 remains between about 70 and 210 volts, the potential difference across the terminals of lamp 72 will remain less than 70 volts and the lamp will not conduct. If, however, the potential of shell 40 rises to 210 volts, lamp 72 will begin to conduct and leak off excessive positive charge from the shell 40, thus preventing its potential from exceeding 210 volts. If, on the other hand, the potential of shell 40 drops to 70 volts, the potential difference between the terminals of lamp 72 will again rise to 70 volts and lamp 72 will begin to conduct. This time, however, lamp 72 conducts in the opposite direction to provide sufficient positive charge to shell 40 to maintain its potential at at least 70 volts.

Lamps 68, 70 and 72 need not be lamps especially designed for voltage regulation, but may be lamps of the type commonly used as indicators in instruments. Neon lamps of this type are readily available for a wide range of breakdown voltages to suit different biasing requirements. The glow given off by lamps 68, 70 and 72 when in a conducting state provides the further benefit of enabling the serviceman to observe visually whether lamps 68 and 70 are operating properly or whether the potential of roller 38 is within the range over which it is allowed to float.

Figure 3:
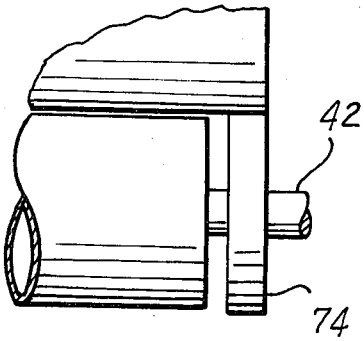
FIG. 3 is a fragmentary side elevation of a modified construction of the injection roller shown in FIG. 1.

While the conductive surface of roller 38 is shown at the outer surface of the roller in FIGS. 1 to 3, the conductive material need only be adjacent to the outer surface to obtain the desired effect. Thus, if desired, a thin insulating coating may be applied to the conductive surface to prevent the conductive surface from coming into intimate electrical contact with the background regions of the image area.

For the contemplated speeds of rotation of roller 38 from about 800 to 2000 rpm, the hydrodynamic force of the layer of developing liquid formed on the shell 40 is sufficient to space the roller 38 the required distance from the imaging layer 16. If desired, however, the roller 38 may be spaced from the imaging layer 16 as shown in FIG. 3 by such positive means as a pair of spacing rollers 74, one at each end of the roller 38, having a small fraction of a millimeter greater diameter than the shell 40 and being rotatably mounted on the shaft 42.

It will be seen that I have accomplished the objects of my invention. My developing system operates relatively rapidly and does not occupy excessive space around the photoconductive imaging drum. My developing system is able to adapt immediately to changes in the average potential of the drum surface, thus facilitating the use of a floating electrode. My developing system does not produce developed images having gray leading edges, and is self-cleaning. Finally, my developing system is simple and inexpensive.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

It is claimed:

1. In an electrophotographic copier, a photoconductor adapted to bear an electrostatic image on its surface, a roller, means for resiliently urging said roller toward said surface, means for supplying liquid developer to said roller, means for moving said photoconductor past said roller, and means for rotating said roller at such a velocity that the hydrodynamic pressure of said liquid developer on said roller forces said roller away from said photoconductor against the action of said urging means to form a gap for the injection of said developer.

2. Apparatus as in claim 1 comprising means for cleaning said roller.

3. Apparatus as in claim 1 in which said supplying means comprises means for immersing a portion of said roller in liquid developer.

4. Apparatus as in claim 1 in which the surface velocity of said roller is at least forty inches per second.

5. Apparatus as in claim 1 in which the surface velocity of said roller is between forty and two hundred inches per second.

6. In an electrophotographic copier, a photoconductor adapted to bear an electrostatic image on its surface, a conductive roller, means for resiliently urging said roller toward said surface, means for supplying liquid developer to said roller, means for moving said photoconductor past said roller, and means for rotating said roller at such a velocity that the hydrodynamic pressure of said liquid developer on said roller forces said roller away from said photoconductor against the action of said urging means to form a gap for the injection of said developer.

7. Apparatus as in claim 6 comprising means for impressing a biasing potential on said roller.

8. Apparatus as in claim 6 in which said roller has a conductive outer surface.

9. Apparatus as in claim 6 in which said roller comprises a conductor adjacent to its outer surface and an insulating layer overlying said conductor.

10. In an electrophotographic copier, a photoconductor adapted to carry an electrostatic image on its surface, a conductive roller, means for disposing said roller adjacent said surface to form a gap therebetween, means for supplying liquid developer to said roller, means for moving said photoconductor past said roller, means for driving said roller at a peripheral velocity substantially greater than the velocity of said photoconductor to inject said developer into said gap, means for providing a biasing potential, and means for coupling said roller to said biasing potential means, said coupling means including a gas discharge tube connected between said roller and said biasing potential means, whereby the difference between the potential of said roller and said biasing potential is limited to the breakdown potential of said tube.

11. Apparatus as in claim 10 in which said roller comprises a conductive outer surface.

12. Apparatus as in claim 10 in which said roller comprises a conductor adjacent to its outer surface and an insulating layer overlying said conductor.

* * * * *